US007839243B1

(12) United States Patent
Chen et al.

(10) Patent No.: US 7,839,243 B1
(45) Date of Patent: Nov. 23, 2010

(54) DEVICES, SYSTEMS, AND METHODS FOR DISSIPATING ENERGY FROM AN ARC

(75) Inventors: Hai Chen, Duluth, GA (US); John D Stephenson, Roswell, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 311 days.

(21) Appl. No.: 11/970,552

(22) Filed: Jan. 8, 2008

Related U.S. Application Data

(60) Provisional application No. 60/911,188, filed on Apr. 11, 2007.

(51) Int. Cl.
*H01H 9/30* (2006.01)
*H01H 9/36* (2006.01)

(52) U.S. Cl. ..... 335/201; 218/34; 218/149; 218/150; 218/151

(58) Field of Classification Search ..... 335/201, 335/202; 218/34, 38, 149–151
See application file for complete search history.

(56) References Cited

U.S. PATENT DOCUMENTS

| | | | | |
|---|---|---|---|---|
| 2,950,371 | A * | 8/1960 | Stringfellow | 218/149 |
| 4,085,393 | A | 4/1978 | Grenier | |
| 5,589,672 | A | 12/1996 | Uchida | |
| 6,297,465 | B1 | 10/2001 | Groves | |
| 6,480,082 | B1 | 11/2002 | Aihara | |
| 6,809,282 | B2 | 10/2004 | Fasano | |
| 7,094,986 | B2 | 8/2006 | Shea | |

FOREIGN PATENT DOCUMENTS

| | | | |
|---|---|---|---|
| JP | 55117832 | * | 9/1980 |

* cited by examiner

*Primary Examiner*—Ramon M Barrera
(74) *Attorney, Agent, or Firm*—Jose de la Rosa

(57) ABSTRACT

Certain exemplary embodiments can provide a system, which can comprise a set of substantially planar arc plates. The substantially planar arc plates can be adapted to cause a dissipation of energy caused by an arc in a circuit breaker. A housing can be adapted to receive each of the set of substantially planar arc plates.

25 Claims, 9 Drawing Sheets

DEVICES, SYSTEMS, AND METHODS FOR DISSIPATING ENERGY FROM AN ARC

CROSS-REFERENCES TO RELATED APPLICATIONS

This application claims priority to, and incorporates by reference herein in its entirety, pending U.S. Provisional Patent Application Ser. No. 60/911,188, filed 11 Apr. 2007.

BACKGROUND

U.S. Pat. No. 7,094,986 (Shea), which is incorporated by reference herein in its entirety, discloses, "arc plates of an arc chute assembly for a circuit breaker are supported in spaced, stacked relation by a structural shell molded of a gas evolving resin. Generation of arc gases, that cool the arc thereby increasing the current interruption capability of the breaker, can be further enhanced by gas evolving additives included in the resin. Arc gas flow is increased to further cool the arc by molding the interior walls of the structural shell to form venturies between the arc plates. One or more elongated fibers wrapped around the stack of arc plates in an oval strengthen the structural shell to withstand the increased pressure generated by the high arc gas volume". See Abstract.

U.S. Pat. No. 5,589,672 (Shea), which is incorporated by reference herein in its entirety, discloses a "circuit breaker is formed of a stationary contact member bent back into a U-shape and having a stationary contact at a bent back portion thereof, a moving contact member situated adjacent to the stationary contact member to be able to contact with the stationary contact, a plurality of grids laminated vertically with a space therebetween, and a unitary molded insulator situated around the stationary contact member. The insulator includes a pair of side walls facing to each other, and a plurality of slots arranged in the opposed side walls to vertically space apart from each other. The grids are inserted into the slots to be vertically piled when the circuit breaker is assembled. The circuit breaker can be easily assembled". See Abstract.

SUMMARY

Certain exemplary embodiments can provide a system, which can comprise a set of substantially planar arc plates. The substantially planar arc plates can be adapted to cause a dissipation of energy caused by an arc in a circuit breaker. A housing can be adapted to receive each of the set of substantially planar arc plates.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
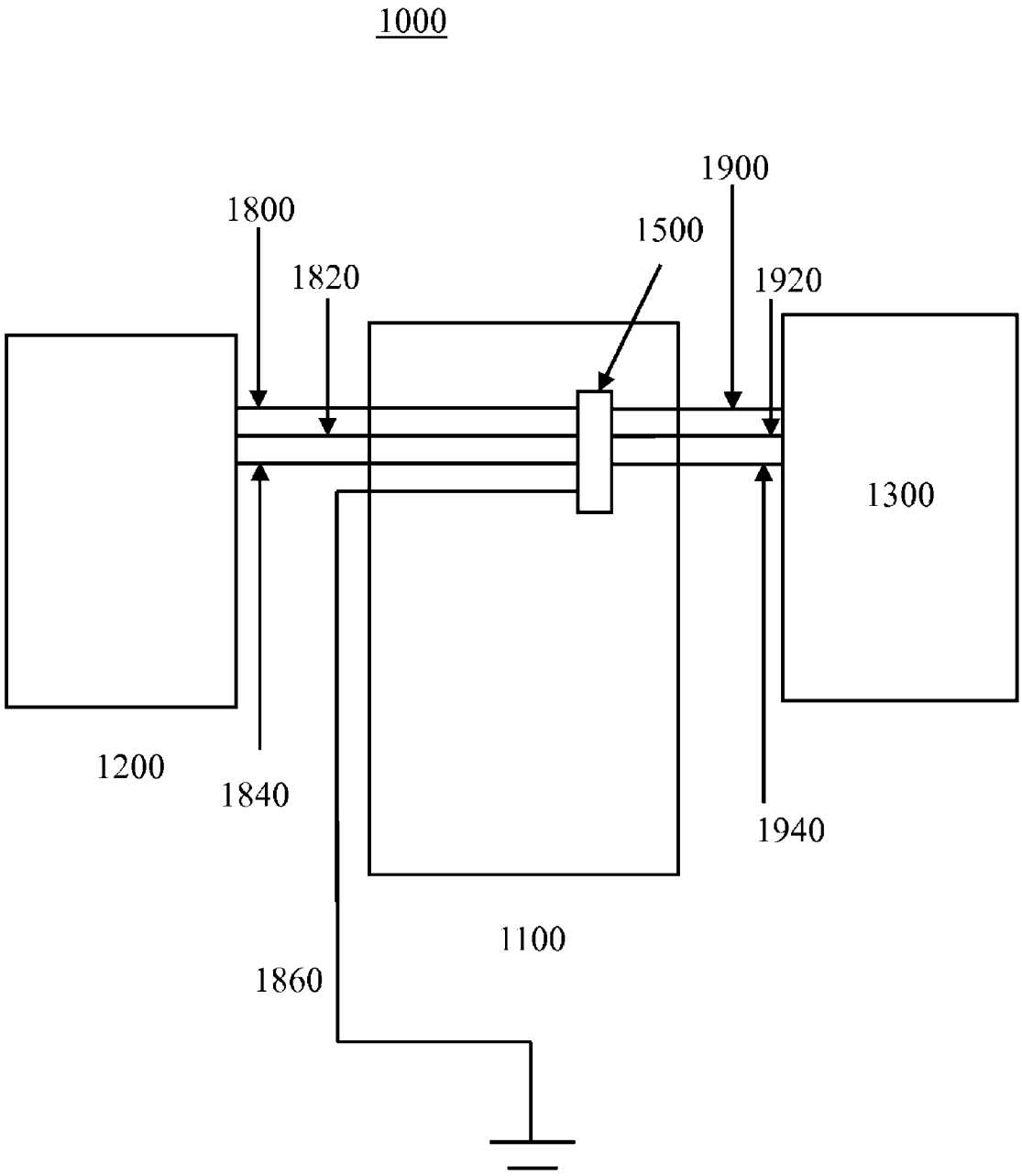
FIG. 1 is a block diagram of an exemplary embodiment of a system 1000.

Certain exemplary embodiments can provide a system, which can comprise a set of substantially planar arc plates. The substantially planar arc plates can be adapted to cause a dissipation of energy caused by an arc in a circuit breaker. A housing can be adapted to receive each of the set of substantially planar arc plates.

When a circuit breaker is automatically tripped by a trip mechanism or manually tripped by a handle, an operating mechanism can be adapted to release a moveable contact arm. In certain exemplary short circuit events, an electrical arc generated during such an operation can be transferred to one or more arc plates and/or arc plate configurations as the contact arm moves through the arc plate and/or arc plate configuration. One or more arc plates can define a recessed space through which the contact arm can pass. The electrical arc can propagate across one or more arc plates and/or an arc plate configuration. Arc plates can be adapted to create, induce, and/or direct an electrical arc to flow, travel, and/or conduct over a defined and/or desired portion of the circuit breaker, and/or to decrease, minimize, and/or limit the duration of time that an arc flows, travels, and/or conducts between the contact surfaces, thereby potentially resisting, reducing, minimizing, limiting, and/or preventing unwanted arc-based erosion and/or arc-based deposition involving one or more of the contact surfaces.

During a short circuit event, a circuit breaker can be adapted to extinguish arcing, high amperage, and/or high voltage involving the circuit. In certain exemplary embodiments, an enhanced arc chamber can comprise multiple arc plates, two side plates, and a polymeric housing (e.g., a nylon housing). Two side plates can comprise a ferrous material. The two side plates can be placed on opposing sides of the arc chamber to enhance a magnetic Lorentz blow-out force. These two side plates can be insulated to protect arc erosions during an arc. The magnetic blow-out force generated from the two side plates can change from time to time due to erosions on the side plates. The multiple arc plates can be designed to have a relatively compact size. The polymeric housing can be adapted to retain the side plates and the arc plates and/or can define a cooling air channel adapted to extinguish the arc relatively efficiently. Certain exemplary embodiments can be adapted for relative ease of system assembly and installation into the circuit breaker.

The arc chamber of the circuit breaker can be an important device and can play an important role in the current interruption process. Certain exemplary embodiments can utilize biconcave lens shaped arc plates and can integrate two side plates in a housing. The housing can define slots to slidably receive each of the arc plates and/or the side plates. Certain exemplary embodiments can be relatively resistant to erosions of the arc plates during the arc.

Certain exemplary embodiments can provide relatively good arc chamber efficiency to interrupt the current. When a single arc crosses contacts during an arc fault, the enhanced arc chamber can generate a magnetic blow-out force to drive the arc into the arc plates to result in several shorter arcs.

Certain exemplary embodiments can provide a relatively uniform and strong Lorentz force to force the arc into an arc baffle. The magnetic blow-out force can result in heat transfer due to the arc movement. According to the "race theory", if a temperature drops quickly due to cooling then a dielectric strength between the contacts increases at a more rapid rate. The polymeric housing can define a relatively effective space with reinforced walls to hold a relatively high pressure. The relatively high pressure can promote a relatively high dielectric strength or breakdown-voltage based on Paschen's law. In certain exemplary embodiments, the polymeric housing can decompose and/or release gases when exposed to heat.

FIG. 1 is a block diagram of an exemplary embodiment of a system 1000, which can comprise an electrical panel 1100. Electrical panel 1100 can be utilized to electrically couple an electrical source 1200 to an electrical load 1300. Electrical load 1300 can be associated with a home, factory, office building, commercial warehouse, store, government building, construction site, sports facility, mobile plant, camp site, recreational facility, trailer home, emergency site, and/or farm, etc.

Electrical panel 1100 can comprise one or more circuit breaker cases 1500.

Components comprised by circuit breaker case 1500 can be operably energizable by 100 volts or greater. A first plurality of conductors can electrically couple electrical source 1200 to components comprised by circuit breaker case 1500. The first plurality of conductors can comprise a first source conductor 1800, a second source conductor 1820, and a third source conductor 1840. A ground 1860 can be electrically coupled to a component of circuit breaker case 1500. Each of first source conductor 1800, second source conductor 1820, third source conductor 1840, and/or ground 1860 can be operably connectable to one or more circuit breakers, such as one or more components comprised by circuit breaker case 1500.

A second plurality of conductors can electrically couple electrical load 1300 to one or more components comprised by circuit breaker case 1500. The second plurality of conductors can comprise a first load conductor 1900, a second load conductor 1920, and a third load conductor 1940. Each of second load conductor 1920, third load conductor 1940, and/or ground 1860 can be operably connectable to one or more circuit breakers, such as components comprised by circuit breaker case 1500.

Figure 2:
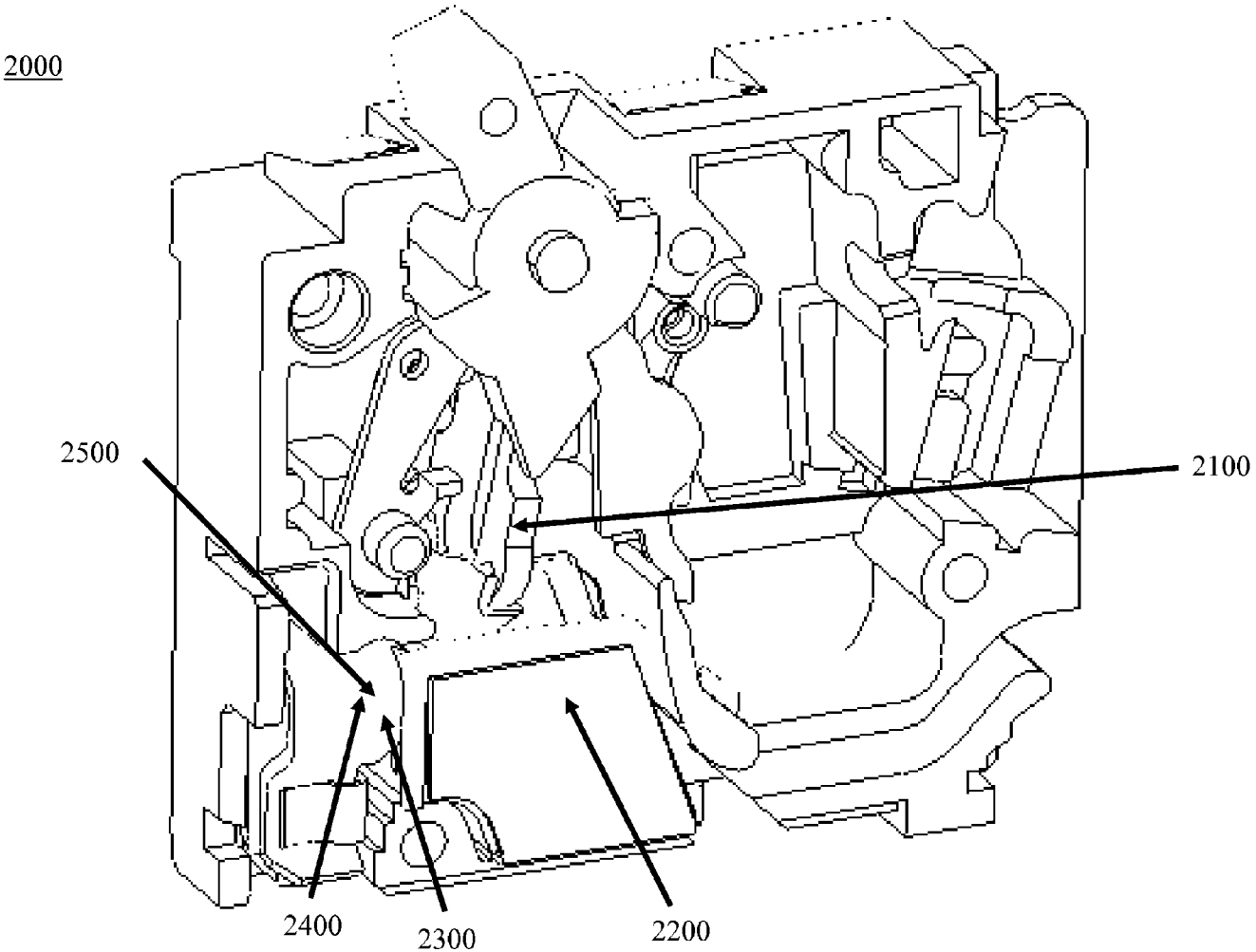
FIG. 2 is a perspective view of an exemplary embodiment of a system 2000.

FIG. 2 is a perspective view of an exemplary embodiment of a system 2000, which can comprise circuit breaker components. System 2000 can comprise a contact arm 2100, which can have an electrical contact surface adapted to be electrically coupled to a line terminal 2400 (note, line terminal 2400 is hidden under a contact skirt 2300). When in motion to be electrically coupled and/or electrically decoupled from line terminal 2400, the contact surface of contact arm 2100 can be partially surrounded by an arc chamber 2200. Other components comprised by system 2000 can be at least partially shielded from an arc and/or spatter that results from the arc via arc chamber 2200. Arc chamber 2200 can comprise, define, and/or be coupled to contact skirt 2300, which can be adapted to restrain any electrical arc and/or spatter that results from any interaction between the contact surface of contact arm 2100 and the line terminal from damaging components of system 2000. An electrical arc can be caused by line terminal 2400 and a contact 2500 associated with a set of substantially planar arc plates (note, contact 2500 is hidden under a contact skirt 2300). Contact 2500 can comprise the contact surface of contact arm 2100. Contact skirt 2300 and/or arch chamber 2200 can be adapted to at least partially enclose electrical contact 2500 on three sides. A portion of contact 2500 that is nearest to the set of substantially planar arc plates can be substantially not enclosed to allow the arc to travel only to the set of substantially planar arc plates.

Figure 3:
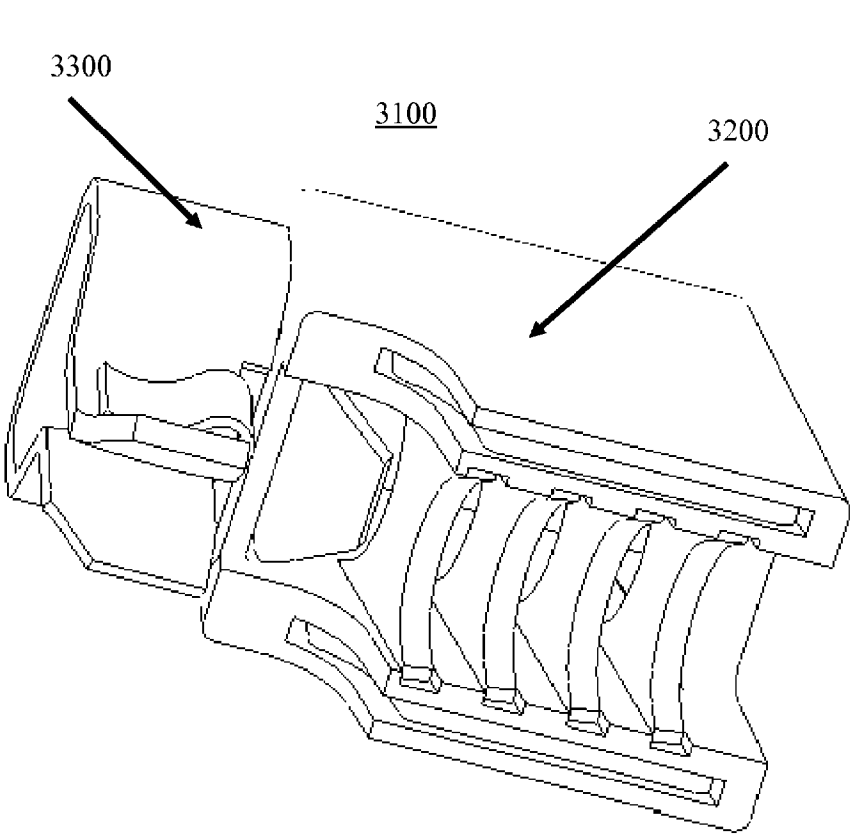
FIG. 3 is a perspective view of an exemplary embodiment of a system 3000.

FIG. 3 is a perspective view of an exemplary embodiment of a system 3000, which can comprise an arc chamber assembly 3100. Arc chamber assembly 3100 can comprise a polymeric housing 3200, which can be an arc extinguishing electrically insulating polymeric housing. In certain exemplary embodiments, polymeric housing 3200 can comprise nylon, a thermoset plastic, and/or a thermoplastic material. Polymeric housing 3300 can comprise and/or be operatively coupled to a contact skirt 3300. Contact skirt 3300 can be adapted to resist transmission of an arc from line terminal and contact arm contact surfaces to a circuit breaker cavity external to arc chamber assembly 3100.

Figure 4:
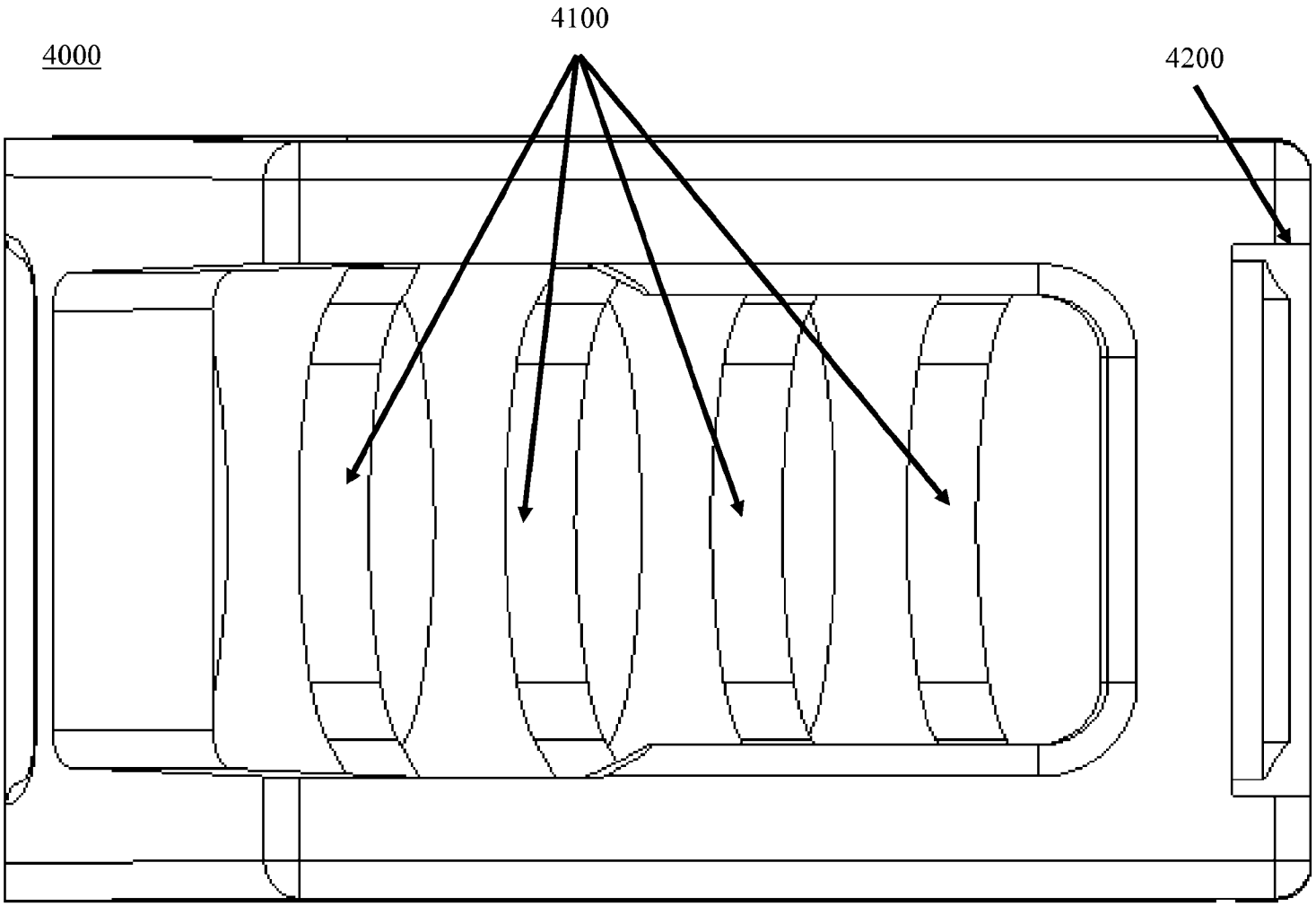
FIG. 4 is a perspective view of an exemplary embodiment of a system 4000.

FIG. 4 is a perspective view of an exemplary embodiment of a system 4000, which can comprise a set of arc plates 4100, each of which can be substantially planar. Each of arc plates 4100 can define a biconcave lens shape. Set of arc plates 4100 can be adapted to cause a dissipation of energy caused by an arc in a circuit breaker. System 4000 can comprise of a contact skirt 4200, which can be adapted to at least partially surround a region of physical and/or electrical contact of a contact arm contact surface and a line terminal contact surface. Contact skirt 4200 can be adapted to at least partially prevent an arc and/or spatter from an arc from damaging one or more circuit breaker components in proximity with system 4000. In certain exemplary embodiments, each of arc plates 4100 can be metal plated by a metal such as nickel, gold, platinum, and/or copper, etc.

Figure 5:
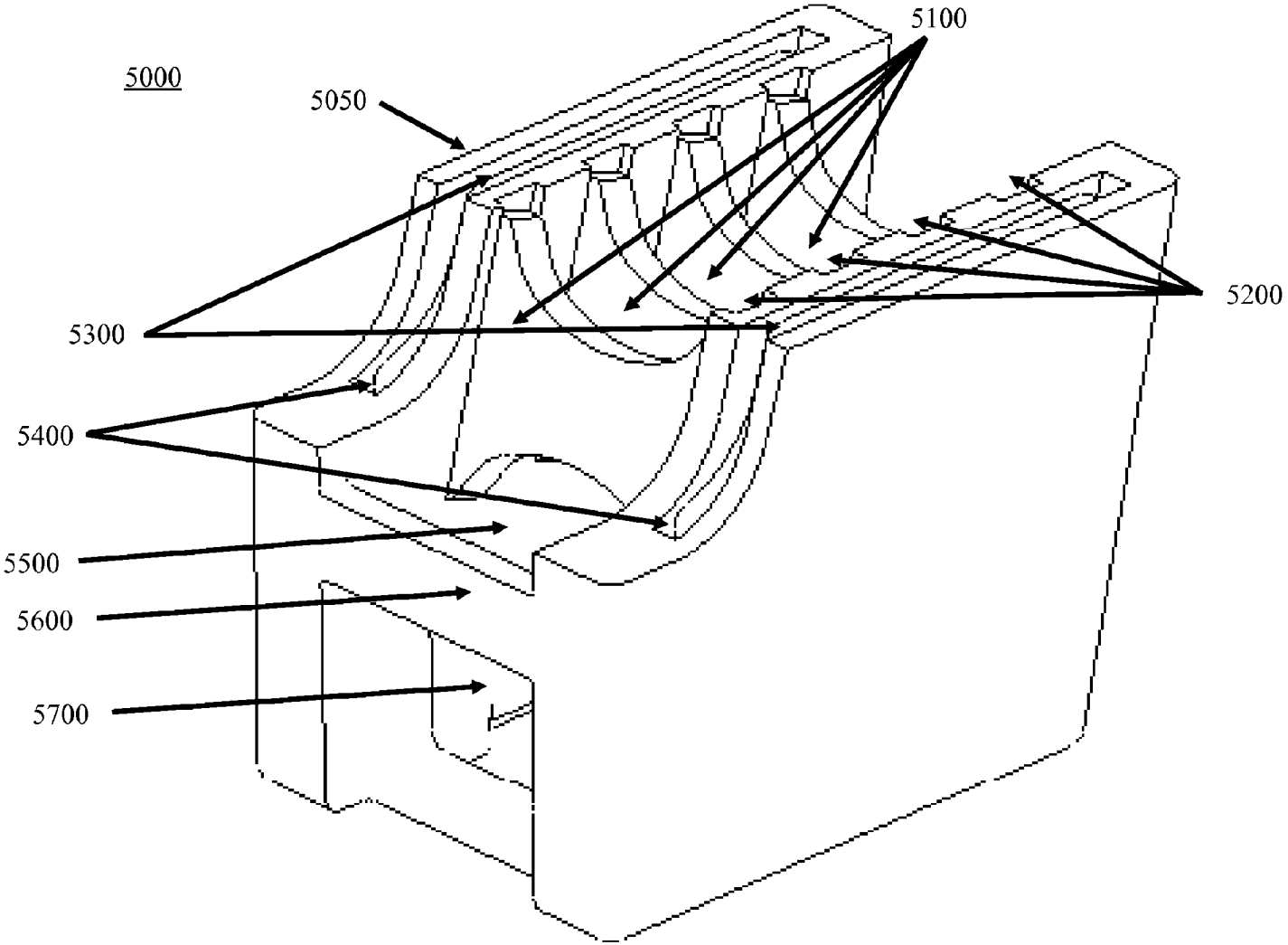
FIG. 5 is a perspective view of an exemplary embodiment of a system 5000.

FIG. 5 is a perspective view of an exemplary embodiment of a system 5000, which can comprise a set of arc plates 5100, each of which can be substantially planar. In certain exemplary embodiments, each of set of arc plates 5100 can define a plane that defines an opposing pair of concave edges. Each of set of arc plates 5100 can be substantially symmetrical about a longitudinal axis defined on the plane and substantially symmetrical about a latitudinal axis defined on the plane. The longitudinal axis can be substantially orthogonal to the latitudinal axis. Each of set of arc plates 5100 can be slidably coupled to a housing 5050 of system 5000 via a set of slots 5200. Set of slots 5200 can be adapted to restrain each of arc plates 5100 such that each plane defined by a length and width of each arc plate of the set of arc plates is substantially parallel to all other planes defined by the length and width of each other arc plates of the set of arc plates. Each of set of arc plates 5100 can be substantially nondestructively removable from housing 5050. Housing 5050 can be adapted to substantially contain metal spatter from set of arc plates 5100.

Each of arc plates 5100 can be magnetically coupled to a pair of substantially planar magnetically conductive side plates 5300. Each of pair of substantially planar magnetically conductive side plates 5300 can be slidably coupled to housing 5050 by a pair of side plate slots 5400. Thereby, housing 5050 can be adapted to receive each of pair of substantially planar magnetically conductive side plates 5300 and each of arc plates 5100. When operatively mounted in housing 5050, planes defined by each of magnetically conductive side plates 5300 can be substantially parallel. Each of substantially planar magnetically conductive side plates 5300 can be adapted to attract an arc to at least one of arc plates 5100.

Housing 5050 can be a polymeric housing. For example, housing 5050 can be made from nylon, polypropylene, polyurethane, polyvinyl chloride, and/or Kevlar, etc. Housing 5050 can be adapted to at least partially surround set of arc plates 5100. Housing 5050 can be adapted to receive each of set of arc plates 5100 such that planes defined by each of set of arc plates 5100 are substantially parallel. Housing 5050 can be adapted to at least partially chemically decompose as a result of the arc and thereby extinguish the arc. System 5000 can define a first exhaust area 5500 and a second exhaust area 5700. First exhaust area 5500 and second exhaust area 5700 can be separated by a nylon cross-member 5600 of housing 5050. First exhaust area 5500 and/or second exhaust area 5700 can be adapted to receive a flow of cooling air adapted for convective heat transfer from one or more surfaces of system 5000 due to the arc and/or to relieve pressure generated by the arc within housing 5050.

Figure 6:
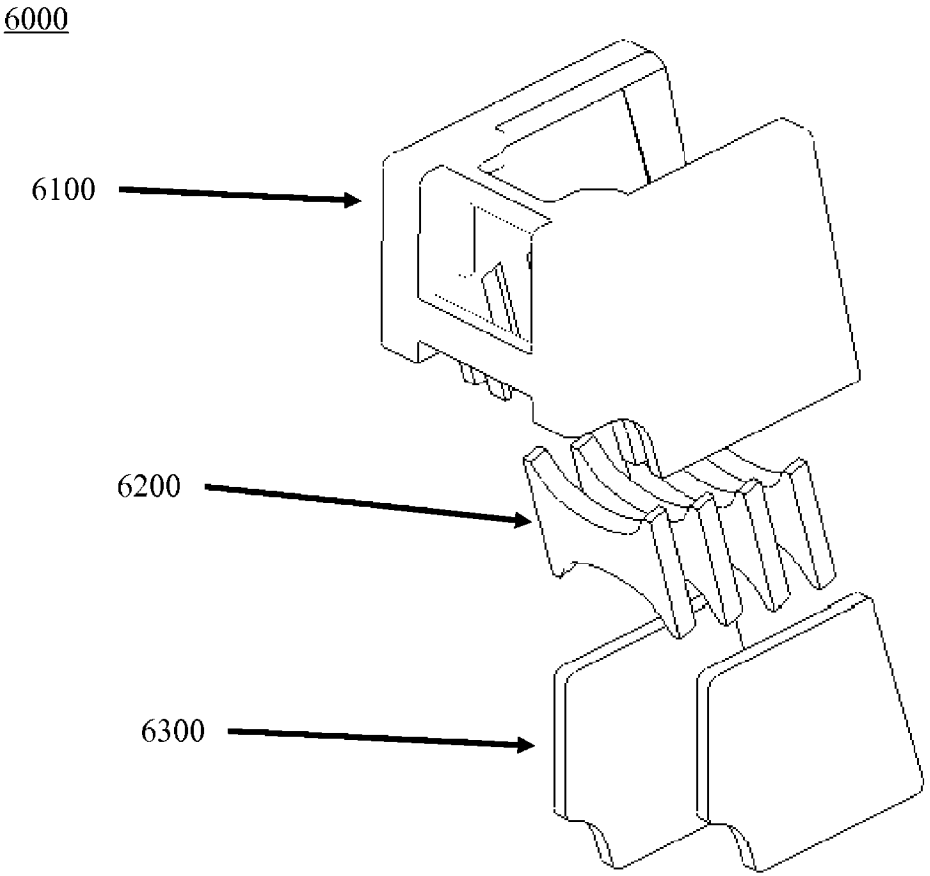
FIG. 6 is an exploded view of an exemplary embodiment of a system 6000.

FIG. 6 is an exploded view of an exemplary embodiment of a system 6000, which can comprise a polymeric housing 6100. Polymeric housing 6100 can be adapted to slidably receive each of a set of substantially planar arc plates 6200. Each of arc plates 6200 can have a biconcave lens shape. Polymeric housing 6100 can be adapted to slidably receive each of a pair of substantially planar magnetically conductive side plates 6300. In operative embodiments, side plates 6300 can be adapted to cause an arc to be attracted to one or more of arc plates 6200.

Figure 7:
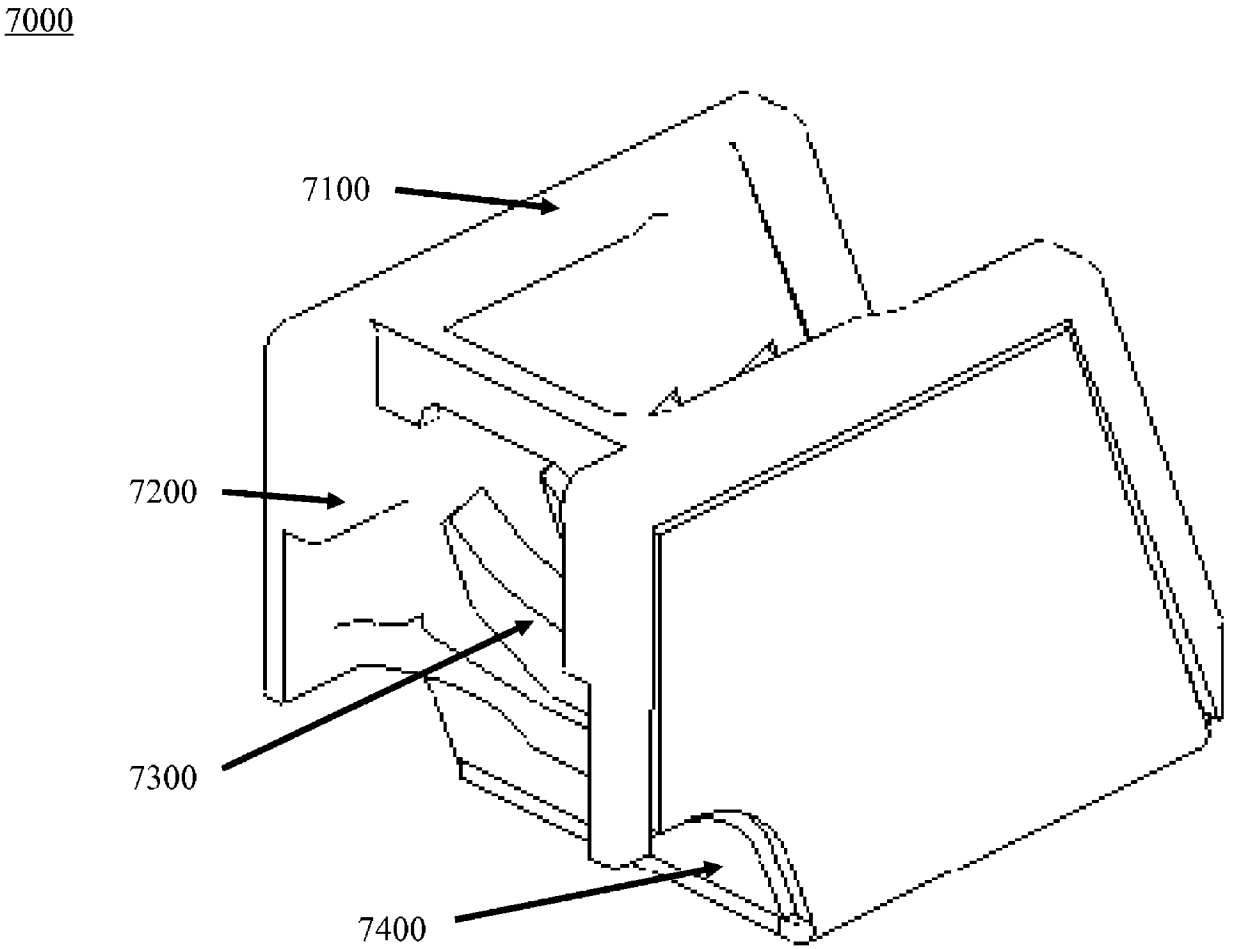
FIG. 7 is a perspective view of an exemplary embodiment of a system 7000.

FIG. 7 is a perspective view of an exemplary embodiment of a system 7000, which can comprise a polymeric housing 7100. Polymeric housing 7100 can comprise and/or define a contact skirt 7200, which can be adapted to prevent arcing erosion on a line terminal, which can be adapted to at least partially enclose an electrical contact associated with system 7000 on three sides. A portion of the contact that is nearest to a set of substantially planar arc plates 7300, which can be substantially not enclosed to allow the arc to travel only to set of substantially planar arc plates 7300. Polymeric housing 7100 can comprise and/or be operatively coupled to an insulated or uninsulated magnetically conductive base 7400, which can be adapted to partially enclose polymeric housing 7100 such that an arc and/or metal splatter therefrom tends to remain within housing 7100.

Figure 8:
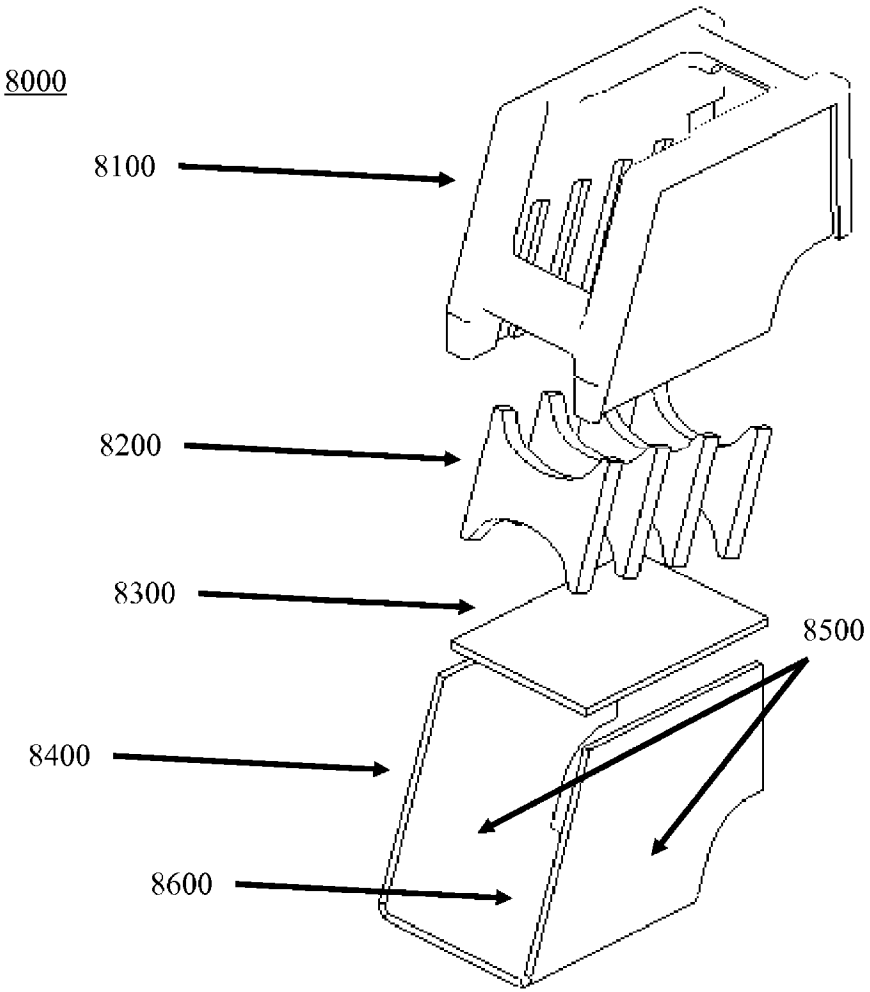
FIG. 8 is an exploded view of an exemplary embodiment of a system 8000.

FIG. 8 is an exploded view of an exemplary embodiment of a system 8000, which can comprise a polymeric housing 8100. Each of a set of substantially planar arc plates 8200 can be operatively coupled to polymeric housing 8100 such that planes defined by a length and width of each of set of arc plates 8200 are substantially parallel. A magnetically conductive "U" shaped part 8400 can be operatively coupled to polymeric housing 8100, such as via being slidably coupled. "U" shaped part 8400 can comprise a pair of substantially planar magnetically conductive side plates 8500. Magnetically conductive side plates 8500 can be connected by a magnetically conductive base 8600 to form "U" shaped part 8400. "U" shaped part 8400 can be adapted to support an installed insulated planar part 8300, which can be made of a substantially electrically and/or magnetically insulating material. In certain exemplary embodiments, when operatively mounted in housing 5050, planes defined by each of two substantially planar side plates 8500 can be substantially parallel. In certain exemplary embodiments, each of set of arc plates 8200 can be operatively restrained in polymeric housing 8100 via "U" shaped part 8400 and insulated planar part 8400 adjacent to "U" shaped part 8400. In certain exemplary embodiments, each of set of arc plates 8200 can be operatively restrained in polymeric housing 8100 via a portion of a circuit breaker.

Figure 9:
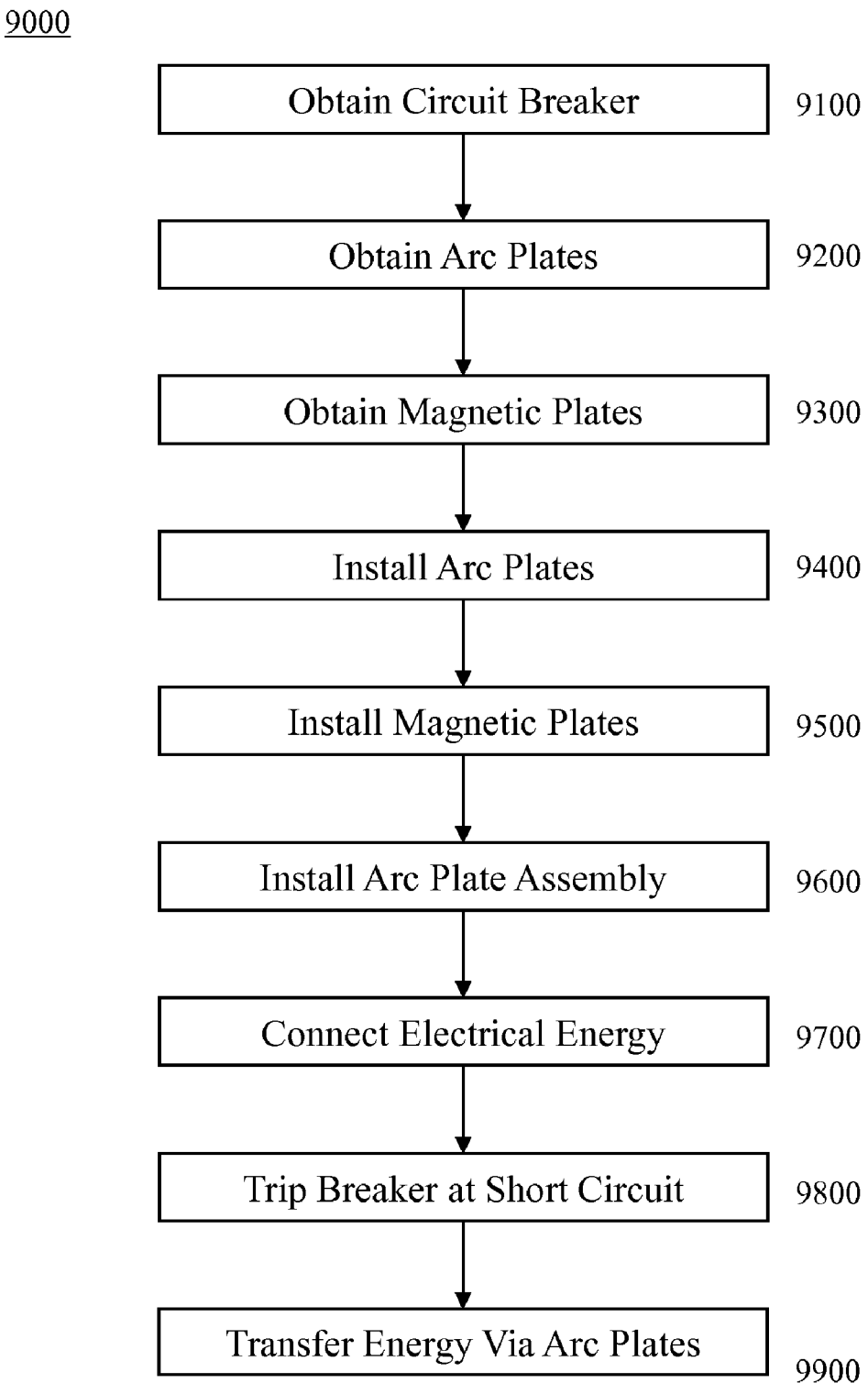
FIG. 9 is a flowchart of an exemplary embodiment of a method 9000.

FIG. 9 is a flowchart of an exemplary embodiment of a method 9000. At activity 9100, a circuit breaker can be obtained. The circuit breaker can comprise a contact arm. The contact arm can comprise an electrical contact adapted to be electrically coupled to a corresponding contact of a line terminal. Opening and closing an electrical connection via moving the electrical contact of the contact arm can cause an arc.

At activity 9200, a set of arc plates and/or arc plate configurations, adapted to be operatively installed in the circuit breaker, can be obtained. Each of the arc plates can be substantially planar and/or have a biconcave lens shape. At activity 9300, magnetic plates can be obtained. The magnetic plates can be operatively coupled to an arc plate housing. The arc plate housing can be a polymeric housing, which can be an arc extinguishing electrically insulating polymeric housing. In certain exemplary embodiments, the polymeric housing can comprise nylon, a thermoset plastic, and/or a thermoplastic material. At activity 9400, the arc plates can be installed in the arc plate housing. Note that, in certain embodiments, activity 9400 can occur prior to activity 9300. The arc plate housing can be adapted to at least partially surround the set of arc plates. When operatively installed, the set of arc plates can be adapted to cause a dissipation of energy caused by the arc.

At activity 9500, the magnetic plates can be installed and/or operatively coupled to the set of arc plates in the arc plate housing. At activity 9600, the arc plate assembly, which can comprise the arc plate housing, the arc plates, and the magnetic side plates, can be operatively installed in the circuit breaker. The housing can be adapted to operatively house the pair of substantially planar magnetically conductive side plates. The pair of substantially planar magnetically conductive side plates can be adapted to attract the arc and/or cause the arc to be attracted to at least one of the set of arc plates when the set of arc plates is operatively installed in the circuit breaker.

At activity 9700, electrical energy can be operatively connected to the circuit breaker. At activity 9800, a circuit breaker can be tripped due to a short circuit condition.

At activity 9900, electrical energy associated with the short circuit can be attracted to the arc plates by the magnetic plates via an arc. The arc plates can be adapted to convert the electrical energy to heat energy, which can be adapted to chemically decompose at least a portion of the arc plate housing. Decomposition of the arc plate housing can be adapted to cause the electrical energy and/or the heat energy to dissipate substantially without causing arcing and/or metal splatter to other portions of the circuit breaker. The electrical bypass conductor and/or the arc plates and/or arc plate configurations can be adapted to attempt to reduce wear and/or damage to contact surfaces of the contact arm and/or an electrical source contact. Certain exemplary embodiments can cause the arc to be extinguished within the circuit breaker via a chemical reaction of the polymeric housing.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

adapted to—suitable, fit, and/or capable of performing a specified function.

allow—to provide, let do, happen, and/or permit.

and/or—either in conjunction with or in alternative to.
apparatus—an appliance or device for a particular purpose.
arc—a flow of an electric current through a gas, which produces light and/or heat.
arc plate—an electrically conductive substantially rigid and/or substantially planar body adapted to act a shunt for a circuit breaker when contacts of the circuit breaker open.
associated with—related to.
at least—not less than.
attach—to fasten, secure, couple, and/or join.
attract—to pull by a physical force.
base—a portion farthest away from a defined opening.
between—in a separating interval and/or intermediate to.
biconcave lens-shaped plate—a substantially planar body defined by a pair of opposing concave faces oriented substantially perpendicular to the plane.
can—is capable of, in at least some embodiments.
cap—a cover.
cause—to bring about, provoke, precipitate, produce, elicit, be the reason for, result in, and/or effect.
caused by—resulting from.
chemically decompose—to break one or more bonds between atoms.
chemical reaction—an interaction between two or more atoms that results in a change in electron sharing between the atoms, which results in a formation and/or destruction of a chemical bond.
circuit breaker—a re-settable device adapted to automatically open an alternating current electrical circuit to protect the circuit from damage caused by overload and/or short circuit.
component—a constituent element and/or part.
comprising—including but not limited to, what follows.
conduct—to act as a medium for conveying something such as heat and/or electricity.
configure—to design, arrange, set up, shape, and/or make suitable and/or fit for a specific purpose.
connect—to physically join, link, couple, and/or fasten two or more entities.
contact—an electrically conductive device having a surface, generally planar, adapted to close an electrical circuit when in physical contact with another electrically conductive surface.
contain—to hold within.
couple—to join, connect, and/or link two things together.
cross-member—a structural unit and/or a distinct part of a whole that connects and/or buttresses two separated members.
define—to establish the meaning, relationship, outline, form, and/or structure of; and/or to precisely and/or distinctly describe and/or specify.
device—an instrumentality adapted to a particular purpose.
dissipate—to cause to lose irreversibly. For example, transferring energy to a surrounding environment dissipates that energy.
each—every one of a group considered individually.
electrical—relating to producing, distributing, and/or operating by electricity.
electrical energy—energy characterized by, and/or adapted to cause, a flow of electric charge through a conductor.
electrically—of, relating to, producing, or operated by electricity.
electrically couple—to connect in a manner adapted to allow a flow of electricity therebetween.
enclose—to surround.
end—an extremity and its vicinity of something that has length; a terminus.
energy—a measurable physical quantity, with dimensions equivalent and/or convertible to mass times velocity squared, that is conserved for an isolated system.
event—an occurrence.
exhaust area—an opening defined by an object, which is adapted to conduct a flow of cooling air.
extinguish—to bring to an end.
fasten—to attach to something else and/or to hold something in place.
fastener—a distinct restraint that attaches two or more things. A fastener can be a screw, bolt, hook and/or loop of a hook and loop fastener system, button, hook, catch, snap, latch, buckle, loop, tie, clamp, connector, coupler, link, band, zipper, releasable adhesive, plug and socket, and/or any other releasable means for attachment, and/or glue, bond, weld, and/or any other permanent means for attachment.
for—with a purpose of.
form—to make, construct, and/or produce.
from—used to indicate a source.
further—in addition.
have—to possess a characteristic.
heat—energy associated with the motion of atoms and/or molecules and capable of being transmitted through solid and fluid media by conduction, through fluid media by convection, and through a fluid and/or empty space by radiation.
house—to enclose, cover, and/or protect.
housing—something that covers, encloses, protects, holds, and/or supports, such as a frame, box, and/or chassis.
install—to set in position and/or prepare for use.
insulate—to
line terminal—an electrical junction point adapted to be electrically coupled to an electrical energy source.
magnetic—having the property of attracting iron and certain other materials by virtue of a surrounding field of force.
may—is allowed and/or permitted to, in at least some embodiments.
metal—any of a category of electropositive elements that usually have a shiny surface, are generally good conductors of heat and electricity, and can be melted or fused, hammered into thin sheets, or drawn into wires.
method—a process, procedure, and/or collection of related activities for accomplishing something.
mount—(n) that upon which a thing is attached; (v) to couple, fix, and/or attach on and/or to something.
nearest—closest in physical proximity to.
nickel—a metallic element having an atomic number of 28.
non—not.
not—a negation of something.
nondestructively—to perform substantially without damaging.
nylon—a thermoplastic polyamide.
plastic—a synthetic and/or semisynthetic polymeric material that can be molded and/or extruded into an object.
occur—to take place.
one—a singular unit.
only—without anything further.
operative—being in effect; operating.
pair—a quantity of two of something.
parallel—of, relating to, or designating lines, curves, planes, and/or or surfaces everywhere equidistant and/or an arrangement of components in an electrical circuit that splits an electrical current into two or more paths.

partially—to a degree, but not necessarily totally.

planar—shaped as a substantially flat two-dimensional surface.

plane—a surface containing all the straight lines that connect any two points on it.

plate—(n) a substantially planar body having a thickness measured perpendicular to the plane that is relatively small in comparison to the width and length of the body; (v) to coat with a thin layer of metal.

plurality—the state of being plural and/or more than one.

polymer—a chemical compound and/or mixture of compounds formed by polymerization (a chemical reaction in which two or more molecules (often called "monomers") combine via covalent chemical bonds to form larger molecules that contain repeating structural units). Examples of polymers include ABS's, polyacetates, polyacrylics, alkyds, epoxies, flourothermoplastics, liquid crystal polymers, nylons, styrene acrylonitriles, polybutylene terephthalates, polycarbonates, thermoplastic elastomers, polyketones, polypropylenes, polyethylenes, polystyrenes, PVC's, polyesters, polyurethanes, thermoplastic rubbers, and/or polyamides, etc.

polymeric—of, relating to, comprising, and/or exhibiting the characteristics of a polymer.

portion—a part, component, section, percentage, ratio, and/or quantity that is less than a larger whole. Can be visually, physically, and/or virtually distinguishable and/or non-distinguishable.

power—energy, a measure of energy and/or work, and/or a rate at which work is done, expressed as the amount of work per unit time and commonly measured in units such as watt and horsepower.

predetermined—established in advance.

provide—to furnish or supply.

receive—to gather, take, acquire, obtain, accept, get, and/or have bestowed upon.

releasably—capable of being freed, in a substantially non-destructive manner, from something that binds, fastens, or holds back.

removable—capable of being moved from a place or position occupied.

remove—to eliminate, remove, and/or delete, and/or to move from a place or position occupied.

resist—to avoid, act, and/or remain firm against and/or in opposition to the actions, effects, and/or force of result—an outcome and/or consequence of a particular action, operation, and/or course.

said—when used in a system or device claim, an article indicating a subsequent claim term that has been previously introduced.

separated—not touching. Spaced apart by something.

set—a related plurality of predetermined elements; and/or one or more distinct items and/or entities having a specific common property or properties.

shape—a characteristic surface, outline, and/or contour of an entity.

short—(n) an abnormal condition of relatively low resistance between two points of different potential in a circuit resulting in an excess flow of current relative to the range of currents typically conducted via the circuit; (v) to cause an abnormal condition of relatively low resistance between two points of different potential in a circuit resulting in an excess flow of current relative to the range of currents typically conducted via the circuit.

shunt—a device adapted to divert a flow of electrical current.

side—a surface bounding a solid object.

skirt—an appendage of a housing adapted to act as an arc barrier.

slideably—a smooth and/or continuous motion of one object relative to another.

spatter—to splash in drops.

substantially—to a considerable, large, and/or great, but not necessarily whole and/or entire, extent and/or degree.

surface—the outer boundary of an object or a material layer constituting or resembling such a boundary.

surround—to encircle, enclose, and/or confine on several and/or all sides.

system—a collection of mechanisms, devices, data, and/or instructions, the collection designed to perform one or more specific functions.

thermoplastic material—a polymeric substance that can be softened by heat and hardened by cooling in a reversible physical process such as, for example, GE Noryl SE1-X (available from GE Plastics, of Pittsfield, Ma.) and/or Asahi Xyron 540V (available from Asahi Kasei America Inc., of New York, N.Y.), etc.

thermoset material—a polymer material that cures, through the addition of energy, to a stronger form, examples of thermoset plastics include ABS, polyacetates, polyacrylics, alkyds, flourothermoplastics, liquid crystal polymers, nylons, styrene acrylonitriles, polybutylene terephthalates, polycarbonates, thermoplastic elastomers, polyketones, polypropylenes, polyethylenes, polystyrenes, PVC's, polyesters, polyurethanes, thermoplastic rubbers, and/or polyamides, etc.

travel—to move from a first location to a second location.

thereby—by means of that.

U shaped part—a component that comprises two opposing sides that are substantially parallel and joined by a substantially perpendicular connecting portion.

via—by way of and/or utilizing.

when—at a time.

wherein—in regard to which; and; and/or in addition to.

within—inside.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and nonlimiting on claim scope.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive.

What is claimed is:

1. A system comprising:

a set of substantially planar arc plates adapted to cause a dissipation of energy caused by an arc in a circuit breaker, each of said substantially planar arc plates define a plane having a biconcave lens shape defined on a second opposing pair of concave edges each contiguous with the plane; and a pair of substantially planar magnetically conductive side plates received alongside the substantially planar arc plates, the pair of substantially planar magnetically conductive side plates adapted to attract said arc to at least one of said set of substantially planar arc plates; and an arc extinguishing electrically insulating polymeric housing adapted to nondestructively releaseably slideably receive each of said pair of substantially planar magnetically conductive side plates and each of said set of substantially planar arc plates.

2. The system of claim 1, wherein:

said polymeric housing is adapted to at least partially surround said set of substantially planar arc plates, said polymeric housing adapted to receive each of said set of substantially planar arc plates such that planes defined by each of said set of substantially planar arc plates are substantially parallel, said polymeric housing adapted to at least partially chemically decompose as a result of said arc and thereby extinguish said arc.

3. The system of claim 1, further comprising:

a substantially electrically non-conductive insulated planar part adapted to be operatively coupled to said polymeric housing.

4. The system of claim 1, further comprising:

a line terminal of said circuit breaker, said arc caused by said line terminal and a contact associated with said set of substantially planar arc plates.

5. The system of claim 1, further comprising:

a contact of said circuit breaker, said arc caused by a line terminal of said circuit breaker and said contact.

6. The system of claim 1, wherein said polymeric housing comprises a thermoset material.

7. The system of claim 1, wherein said polymeric housing comprises a thermoplastic material.

8. The system of claim 1, wherein said a pair of substantially planar magnetically conductive side plates are connected by a magnetically conductive base to form a "U" shaped part.

9. The system of claim 1, wherein said a pair of substantially planar magnetically conductive side plates are connected by a magnetically conductive base to form a "U" shaped part, wherein when operatively mounted in said polymeric housing, planes defined by each of said two substantially planar side plates are substantially parallel.

10. The system of claim 1, wherein when operatively mounted in said polymeric housing, planes defined by each of said substantially planar magnetically conductive side plates are substantially parallel.

11. The system of claim 1, wherein said set of substantially planar arc plates is nondestructively removable from said polymeric housing.

12. The system of claim 1, wherein said polymeric housing is adapted to contain metal spatter from said set of substantially planar arc plates.

13. The system of claim 1, wherein an end of said polymeric housing defines a first exhaust area and a second exhaust area, said first exhaust area and said second exhaust area separated by a nylon cross-member of said polymeric housing.

14. The system of claim 1, wherein said polymeric housing defines a contact skirt, said contact skirt adapted to at least partially enclose an electrical contact associated with said system on three sides, a portion of said contact that is nearest to said set of substantially planar arc plates substantially not enclosed to allow said arc to travel only to said set of substantially planar arc plates.

15. The system of claim 1, wherein said polymeric housing comprises nylon.

16. The system of claim 1, wherein each of said set of substantially planar arc plates is slidably coupled to said polymeric housing.

17. The system of claim 1, wherein each of said set of substantially planar arc plates is operatively restrained in said polymeric housing via a "U" shaped part.

18. The system of claim 1, wherein each of said set of substantially planar arc plates is operatively restrained in said polymeric housing via a "U" shaped part and an insulated planar part adjacent to said "U" shaped part.

19. The system of claim 1, wherein each of said set of substantially planar arc plates is operatively restrained in said polymeric housing via a portion of said circuit breaker.

20. The system of claim 1, wherein said a pair of substantially planar magnetically conductive side plates are slidably coupled to said polymeric housing.

21. A system comprising:

a set of substantially planar arc plates adapted to cause a dissipation of energy caused by an arc in a circuit breaker, each of said substantially planar arc plates having a biconcave lens shape; and a pair of substantially planar magnetically conductive side plates adapted to attract said arc to at least one of said set of substantially planar arc plates; and an arc extinguishing electrically insulating polymeric housing adapted to nondestructively releaseably slideably receive each of said pair of substantially planar magnetically conductive side plates and each of said set of substantially planar arc plates wherein each of said set of substantially planar arc plates define a plane that defines an opposing pair of concave edges, each of said set of substantially planar arc plates substantially symmetrical about a longitudinal axis defined on the plane and substantially symmetrical about a latitudinal axis defined on the plane, the longitudinal axis orthogonal to the latitudinal axis.

22. A method comprising:

causing an arc to be extinguished within a circuit breaker via a chemical reaction of a polymeric housing, said polymeric housing adapted to at least partially surround a set of substantially planar arc plates, each of said substantially planar arc plates define a plane having a biconcave lens shape defined on an opposing pair of concave edges each contiguous with the plane, said polymeric housing adapted to operatively house a pair of substantially planar magnetically conductive side plates, said pair of substantially planar magnetically conductive side plates received alongside the set of substantially planar arc plates, the pair of substantially planar magnetically conductive side plates adapted to attract said arc to at least one of said set of substantially planar arc plates.

23. A method comprising:

causing an arc to be attracted to a set of substantially planar arc plates operatively installed in a circuit breaker, said arc attracted to said set of substantially planar arc plates by a pair of substantially planar magnetically conductive side plates received alongside the set of substantially planar arc plates, each of said set of substantially planar arc plates and said pair of substantially planar magnetically conductive side plates operatively coupled to a polymeric housing, said set of substantially planar arc plates adapted to cause a dissipation of energy caused by said arc, each of said substantially planar arc plates define a plane having a biconcave lens shape defined on an opposing pair of concave edges each contiguous with the plane.

24. A device comprising:

a polymeric housing adapted to at least partially surround a set of substantially planar arc plates, said polymeric housing adapted to nondestructively releaseably slideably receive each of said set of substantially planar arc plates such that planes defined by each of said set of substantially planar arc plates are substantially parallel, said polymeric housing adapted to receive a pair of substantially planar magnetically conductive side plates alongside the set of substantially planar arc plates, the pair of substantially planar magnetically conductive side plates adapted to attract an arc to at least one of said set of substantially planar arc plates, each of said substantially planar arc plates define a plane having a biconcave lens shape defined on a second opposing pair of concave edges each contiguous with the plane.

25. An apparatus, comprising:

a set of substantially planar arc plates adapted to cause dissipation of energy caused by an arc in a circuit breaker, each of the substantially planar arc plates defining a plane having a biconcave lens shape defined on an opposing pair of concave edges each contiguous with the plane, and each of the set of substantially planar arc plates including an opposing pair of side edges;

a pair of substantially planar magnetically conductive side plates connected by a magnetically conductive base to form a U-shaped part, the pair of substantially planar magnetically conductive side plates received alongside the opposing pair of side edges of each of the set of substantially planar arc plates wherein the substantially planar magnetically conductive side plates are adapted to attract the arc to at least one of the set of substantially planar arc plates;

an insulated planar part; and an arc extinguishing electrically insulating polymeric housing adapted to nondestructively releaseably and slideably receive each of the pair of substantially planar magnetically conductive side plates and each of the set of substantially planar arc plates wherein the U-shaped part and the insulated planar part operatively restrain the set of substantially planar arc plates in the arc extinguishing electrically insulating polymeric housing.

* * * * *